US005219247A

United States Patent [19]

Gemmi et al.

[11] Patent Number: 5,219,247

[45] Date of Patent: Jun. 15, 1993

[54] METHOD OF FORMING CONSOLIDATING EARTH COLUMNS BY INJECTION, THE RELEVANT PLANT WITH DOUBLE CHAMBER PNEUMATIC HAMMER BORING DRILL AND THE RESULTING COLUMN

[75] Inventors: Bruno Gemmi, Basilicagoiano; Antonio Sanella, Noceto, both of Italy

[73] Assignee: Fondazioni Speciali S.r.l., Parma, Italy

[21] Appl. No.: 736,328

[22] Filed: Jul. 26, 1991

[30] Foreign Application Priority Data

Jul. 31, 1990 [IT] Italy ..... 40111 A/90

[51] Int. Cl.[5] ..... E02D 15/04; E02D 27/012

[52] U.S. Cl. ..... 405/241; 405/240; 405/248; 405/237

[58] Field of Search ..... 405/233, 236, 240, 241, 405/242, 248, 237, 238

[56] References Cited

U.S. PATENT DOCUMENTS

| | | | |
|---|---|---|---|
| 1,501,643 | 7/1924 | Blumenthel et al. | 405/237 |
| 2,920,455 | 1/1960 | Ryser et al. | 405/241 |
| 3,228,200 | 1/1966 | Dufresne | 405/241 |
| 3,499,293 | 3/1970 | Kato | 405/241 |
| 3,507,124 | 4/1970 | Turzillo | 405/241 |
| 4,397,588 | 8/1983 | Goughnour | 405/233 X |

FOREIGN PATENT DOCUMENTS

| | | | |
|---|---|---|---|
| 1010103 | 6/1952 | France | 405/237 |
| 2042031 | 9/1980 | United Kingdom | 405/241 |

*Primary Examiner*—Dennis L. Taylor
*Assistant Examiner*—Arlen L. Olsen
*Attorney, Agent, or Firm*—Lowe, Price, LeBlanc & Becker

[57] ABSTRACT

A method apparatus, and product of forming consolidated earth columns of cement grout or mortar to be used, for instance, in building foundations. The method is designed to drastically reduce the time taken to form consolidation columns and to allow consolidation of earth particularly difficult to bore. The method consists of injecting the consolidating grout during the ascent of the drilling tool from the earth supplying air, at the same time, to the pneumatic percussion tool used to make the preliminary drilling.

The plant to put the method into effect comprises a rotating joint manifold (6) at the upper end of the boring drill (11), equipped with tangentially arranged inlets, even inclined; an air manifold (15) to supply compressed air to the pneumatic percussion tool through the external annular chamber (28) of said boring drill (11); a grout distributor (36) equipped with ejection nozzles (38) the axes of which are inclined with respect to the axis of the drill. The column (46) is cylindrical in shape, with transversal projections (47).

13 Claims, 4 Drawing Sheets

48
Z 49
57
46
50
47
51
55
52
56
54
53

METHOD OF FORMING CONSOLIDATING EARTH COLUMNS BY INJECTION, THE RELEVANT PLANT WITH DOUBLE CHAMBER PNEUMATIC HAMMER BORING DRILL AND THE RESULTING COLUMN

TECHNICAL FIELD

This invention relates to a method and apparatus for forming consolidating earth columns by injection, and to consolidated earth columns obtained according to said method, and more particularly to a new method of forming reinforced columns in grounds difficult to drill, formed by rock intrusions in "soft" layers, using cement grout for example, said columns being obtained by means of an apparatus comprising a pneumatic hammer drill provided with coaxial conduits for air and consolidating grout.

BACKGROUND ART

The state of art comprises an earth consolidation method according to which only cement grout is injected to obtain reinforcing columns. This method comprises a first step of drilling with an excavating tool a preliminary hole having a diameter of about 60 to 90 mm to a depth equal to the depth of the reinforcing column to be formed, usually between approximately 10 m and 30 m. If the excavating head has to drill layers of compact ground that are difficult to drill, it is necessary to exert an impulsive stress repeatedly on the top of the excavating tool, using a percussion hammer for example, in order to break up the layers of compact ground. The impulsive stress may also be exerted on the excavating head, using a so-called "boring bottom" pneumatic percussion hammer.

If the ground has a medium resistance to drilling, a supply of cleaning water is injected into the hole while the drilling is in progress; said supply of water being interrupted before grout injecting is started. When pneumatic tools are used, the supply of cleaning water may be replaced by a supply of compressed air generated by the tools.

The method comprises a second step of injecting grout into the preliminary hole.

If a boring bottom hammer has been used to drill the preliminary hole, before starting the second step of the method, the excavating tool must be drawn from the hole and the excavating head of the tool replaced with a rotary grout distributing device. The tool is then reinserted in the hole and grout injection is started. The grout is injected via a pair of jets positioned diametrically opposed in the excavating head, the jets having a flow diameter of between 1 and 3 mm.

While the grout it injected, the distributing device is gradually drawn from the hole at a constant translation speed to form a column having a diameter of between 60 and 120 cm.

The cross-section of the column is substantially circular if the earth is homogeneous, but may be irregular, it the earth is not homogeneous.

Another method according to the prior art comprises drilling a hole into the ground using a pneumatic percussion hammer and injecting the grout while the hammer is moving upward. The grout is injected through the same conduits previously used for the compressed air supply.

The apparatus used for this method comprises hollow, rotary drills, equipped at the bottom with excavating heads provided with three-cone or three-blade bits, if a soft ground has to be drilled; however, if a ground comprising rock intrusions or layers of hard material has to be drilled, the excavating heads are equipped with pneumatic boring bottom hammers.

While drilling is in progress, the rotary drills are fed either by a water pump unit or by an air compressor driving the pneumatic hammers.

When the hole has been completed, a grout is injected at a pressure of about 500 bar and at a flow rate of 150 1/min through radially opposed nozzles with a flow diameter of approximately 1 to 3 mm, said nozzles being distributed around the periphery of a grout distributor fitted at the base of the drill; the flow of grout being supplied to the drill via a rotary joint-type manifold with a radial inlet perpendicular to the axis of the drill.

This method however is time-consuming and considerably complicated because regular cleaning and frequent replacement of obstructed nozzles are necessary.

Furthermore, slight deviations of the drilling axis may often occur due to a lack of uniformity of the earth composition, particularly when three-cone or three-blade drilling equipments are used, said deviations resulting in irregular columns with inadequate resistance that are unsuitable to constitute a formation of closely-packed or interpenetrating elements making up, for example, waterproof barriers or surroundings for wells.

With respect to the plant, it is to be noticed that the rotary joint manifold is subject to a stress substantially perpendicular to the axis of the drill which causes an uneven wear of the manifold seals. The uneven wear of the seals allows grout to leak out from the internal chamber of the manifold between the internal rotary section and the external sliding section of the joint manifold, thereby causing the seizure of the joint.

In addition, the use of percussion hammers at the top of the drill requires the use of large supporting pylons, thereby increasing the size of the plant. Furthermore, if pneumatic boring bottom percussion hammers are used, then it is necessary to remove the pneumatic percussion hammer before injecting grout, because the delicate mechanical components of the hammer would be irreparably damaged if they were to come into contact with the consolidating grout. The removal of the hammer causes a considerable waste of time.

In addition, if the earth is not stable around the drilled hole, the insertion of the grout distribution into the hole may be slowed down by earth collapsed into the hole.

Attempts to inject the grout through the same conduits used to supply compressed air to the percussion hammer have failed, mainly because residuals of grout inside the conduits damages the hammer when it is supplied with compressed air, unless the conduits are thoroughly cleaned every time they are used to inject grout, with a considerable reduction in productivity.

As far as the consolidating column is concerned, the substantially circular shape limits the working load thereof. It is true that the irregular shape of the column obtained when the earth is not homogeneous, as well as the presence of large-sized lithoid elements in the column, increases the vertical sliding friction thereof: however the presence of such elements and the dimensions thereof cannot be controlled or predicted.

The techniques previously described are open to considerable improvement in order to avoid the above mentioned problems.

SUMMARY OF THE INVENTION

The present invention overcomes the above problems by providing a method of forming consolidating earth columns with increased efficiency, particularly when columns are to be formed in extremely hard types of ground or in grounds with rock intrusions, such a method reducing time consumption and increasing productivity. Furthermore, this invention provides a drilling apparatus that is reliable and does not require long and costly maintenance and fitting up procedures after each drilling operation, the apparatus being provided with a rotary joint manifold so designed as to prevent seizure, the columns formed according to the method being highly resistant to sinking.

The method according to the invention comprises the following steps:

A. preparing a consolidating grout, comprising aggregates with a granule size within the sand range, or mixed with polymeric or fibrous substances designed to obtain increasing resistance and with substances giving the grout the following special features: elasticity, water-tightness, resistance, friction-proof quality, resistance to washing away, more lengthy or delayed setting, the particle size of each constituent not exceeding one third of the diameter of an opening through which a flow of the grout is injected into the earth;

B. drilling with a drill to a required penetration depth, by exerting an impulsive stress repeatedly on the earth, via an excavating drill head equipped with a pneumatic percussion tool provided with a supply of compressed air at a pressure between approximately 5 and 30 bar;

C. injecting a flow of the consolidating grout, via at least one jet, or preferably a pair of jets, each with a flow diameter of between approximately 2 and 15 mm, the jets being positioned diametrically opposite each other on a surface inclined from a drilling axis at an angle of between about 15° and 90°, the consolidating grout being injected with the jets rotating around the drilling axis and as the drill rises from a bottom of a boring wherein the grout is fed at a pressure of at least about 500 bar at a flow rate of up to about 1000 l/min as determined upstream from the drill, a supply of air being maintained to the pneumatic percussion tool at a pressure sufficient to prevent the grout from entering the tool, the consolidating grout being supplied by a downward swirling movement thereof at the mouth of the drill; and D. forming a column while the drill is moving upward by regulating the vertical translation speed as well as the rotation speed of the drill and the flow rate and pressure of the grout according to the composition of the earth being worked and the form required for the column such that for cylindrical sections such parameters are constant and for truncated cone-shaped sections the translation speed is reduced and/or the pressure or flow rate of the grout increased.

The apparatus used to carry out this method comprises the following devices:

a rotary joint manifold, connected coaxially to the top of a drill, comprised of a tubular section, with different outer diameters along its length, through which a consolidating grout coming from a feed chamber above enters a central conduit in the drill, said feed chamber being housed inside a hollow head of the joint manifold and rotationally supported by said tubular section, said hollow head being provided with two inlet ports tangentially arranged with respect to the feed chamber, the axis of each port being inclined form a plane perpendicular to the axis of the drill at an angle of between approximately 5° and 50°, so that the consolidating grout is injected into the chamber with a downward swirling movement, the inlet ports being positioned in such a way as to create a pulsating torque having a frequency equal to the frequency of the pump and a direction opposite to the direction of rotation of the drill, thereby preventing the head from being frictionally dragged by the drill;

a manifold for supplying compressed air to a pneumatic boring bottom percussion hammer, comprising a central chamber fitted with an axially disposed through hole through which the consolidating grout coming from the rotary joint manifold is supplied to a grout distributor, the manifold being fixed to the rotary drill and supporting rotationally an external sleeve which translates with the drill and is connected to a compressed air supply hose, an annularly compressed air feed chamber being defined between the central chamber and the external sleeve, said feed chamber being connected to an annular external conduit of the drill through passages deviating the flow of compressed air from a radial direction to a longitudinal working direction;

a consolidating grout distributor fixed to the bottom end of the drill and aligned with it, provided at the bottom end with a pneumatic percussion hammer, fed by a compressed air supply conduit having an annular cross section coaxial with the drill and encompassing a central grout feed conduit; said grout distributor being equipped with at least one transverse conduit, preferably a pair of conduits positioned diametrically opposite each other at different heights, leading from the central grout feed conduit to an external lateral surface of the distributor, an ejection nozzle with a flow diameter of between approximately 3 mm and 15 mm being fitted at the outer end of each transverse conduit, each nozzle being positioned on a surface inclined from the axis of the drill at an angle of between about 15° and 90°, the nozzle, or the lower of the pair of nozzles, being situated on the external lateral surface of the distributor, at a distance of about 1 to 3 m from the pneumatic boring hammer, so that the boring hammer is not subject to overpressures as a result of the injection of grout.

An example of application of the method according to the invention is hereby described with reference to the consolidation of a ground with a plurality of layers as illustrated in FIG. 6, comprising:

a first layer (49, 50 in FIG. 6) of sand-mud, with odd stones of a diameter exceeding 30 cm, with a "standard penetration test" result between about 10 and 20;

a second layer (51 in FIG. 6) of broken sandstone, with an extremely high result in the "standard penetration test";

a third layer (52, 53 in FIG. 6) of gravelly sand and sandy gravel, with a "standard penetration test" result between about 10 and 30;

a fourth layer (54 in FIG. 6) of compact sandstone, with extremely high result in the "standard penetration test".

Between the second and third layers and in the middle of the third layer, quartzite stone elements are found, large in size, with a diameter, for example, of between about 200 and 500 cm.

The consolidation method described in this example comprises the formation of grout columns with cylindrical sections having a diameter of between about 60 cm and 100 cm and truncated cone-shaped sections having an average diameter of between about 90 cm and 135 cm.

The grout columns are formed using a drill according to the invention, having a diameter between 90 and 120 mm and equipped with a grout distributor having a pair of ejector nozzles positioned at different heights at a vertical distance of about 10–15 cm, the axis of each nozzle being inclined from the drill axis at an angle of 60°, the flow diameter of each nozzle being between 3 and 5 mm.

It is to be noted that the minimum diameters of the cylindrical and truncated cone-shaped sections of the columns are obtained using the minimum values of the working parameters specified hereinbelow and nozzles with a diameter of 3 mm, while the maximum diameters of the columns are obtained by using the maximum values of the working parameters and nozzles with a diameter of 5 mm.

| | |
|---|---|
| Composition of consolidating grout: | |
| Water | 750 kg/m$^3$ |
| Cement | 770 kg/m$^3$ |
| Working parameters: | |
| Air supply pressure | from 10 to 12 bar |
| Consolidating grout flow rate | from 150 to 600 l/min |
| Vertical translation speed of the drill when the drill is moving upward | |
| for cylindrical sections | approx. 0.004 m/s |
| for truncated cone-shaped sections | approx. 0.002 m/s |
| Drill rotation speed | from 10 to 30 Rpm |

The composition of the consolidating grout may be modified as specified hereinbelow, according to the features of the ground:

| | |
|---|---|
| water | 200 to 600 kg/m$^3$ |
| cement | 100 to 600 kg/m$^3$ |
| aggregates | 300 to 1000 kg/m$^3$ |

the density of the consolidating grout being less than 2200 kg/m$^3$.

The consolidating grout may comprise the additives specified here below:

| | |
|---|---|
| bentonite | 1 to 5% by weight |
| plastifying or densifying agent | 0.1 to 5% by weight |
| epoxy resins | 0.1 to 5% by weight |
| reswelling polymers | 0.1 to 5% by weight |

The advantages of this invention are: reduction in time taken to form consolidation columns and consequently a considerable reduction in costs, considerably simplified drilling cycle, greater reliability of the apparatus, reduced danger of seizure of the rotary joint manifold, possibility of consolidating sunken earth, formation of non-cylindrical columns with improved resistance.

DETAILED DESCRIPTION OF THE INVENTION

Figure 1:
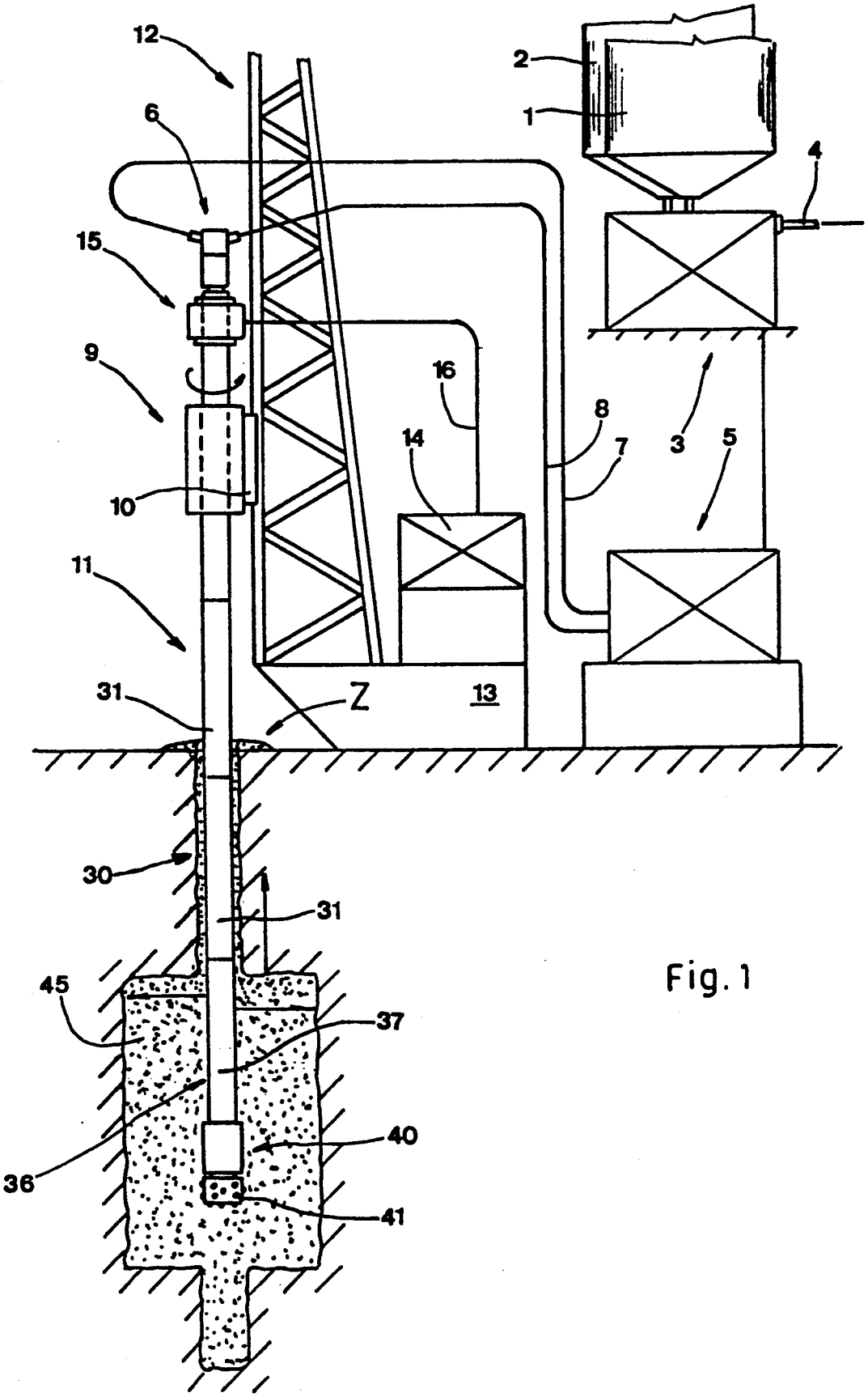
FIG. 1 is a schematic view of an apparatus for forming consolidating columns injected at high pressure according to the method of the invention, with a cross section of the underlying earth illustrating the area in which the column is formed.
Figure 2:
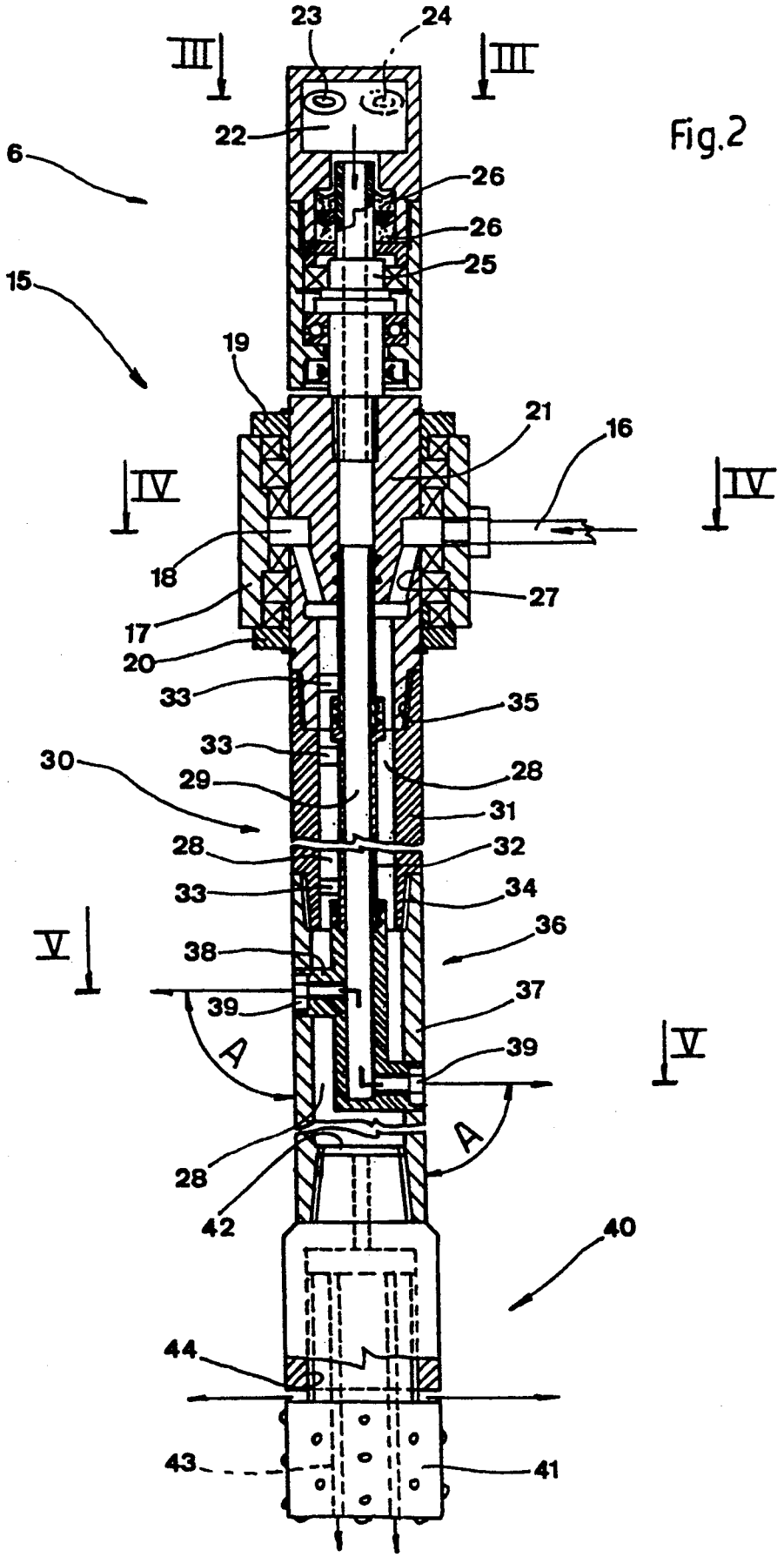
FIG. 2 is a longitudinal section of the drill.

A water mixer 3 is fed via pipe 4 with cement stored in a container 1 and aggregates contained in silos 2 containing lithoid substances having a granule size also exceeding the sand range. Chemical reagents such as clays, ground fibers or other reagents may be added to sand and cement.

A pumping station 5 takes consolidating grout from the mixer 3 and sends it at high pressure and flow rate, to a rotary joint manifold 6 via a pair of hoses 7 and 8.

A chuck 9 slides vertically along a slideway 10 which drives a rotary drill 11 into the earth. The chuck 9 is provided with two internal concentric chambers and the slideways 10 are fitted at the side to a pylon whose height is proportional to the boring depth required. The pylon may be supported on a support 13, usually mobile.

A compressor unit 14 provides the boring bottom hammer with a supply of compressed air at a pressure of between 10 and 30 bar and clears the material removed by the hammer.

An air manifold 15 is equipped with a compressed air supply hose 16 and positioned immediately below the rotary joint manifold 6. Manifold 15 comprises an external sleeve 17 with radially-positioned holes through which air is fed into an annular chamber 18.

Lower and upper rings 19 and 20 are used to secure the sleeve 17.

A tubular section 21 of air manifold 15 is equipped with a through axial hole allowing passage of the consolidating grout coming from a grout feed chamber 22 provided in the rotary joint manifold 6.

Figure 3:
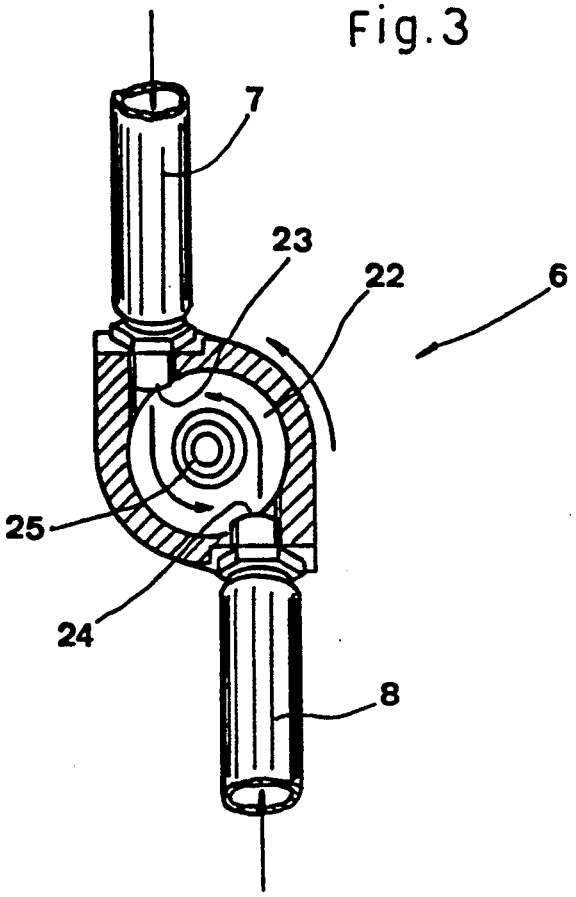
FIG. 3 is an enlarged cross section of the rotary joint manifold shown in FIG. 2 as seen in the direction of arrows from the line III—III, showing the grout inlet section.
Figure 5:
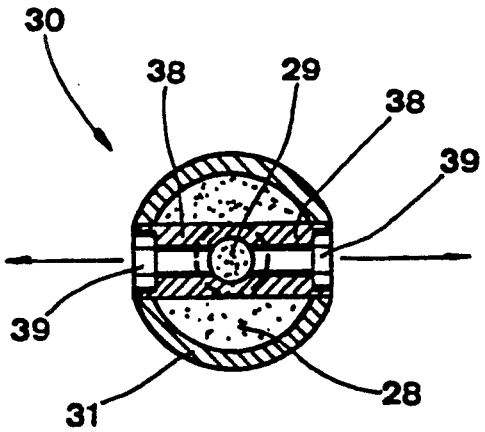
FIG. 5 is a deviated cross section of FIG. 2, seen in the direction of arrows from line V—V, showing the ejection nozzles.
Figure 4:
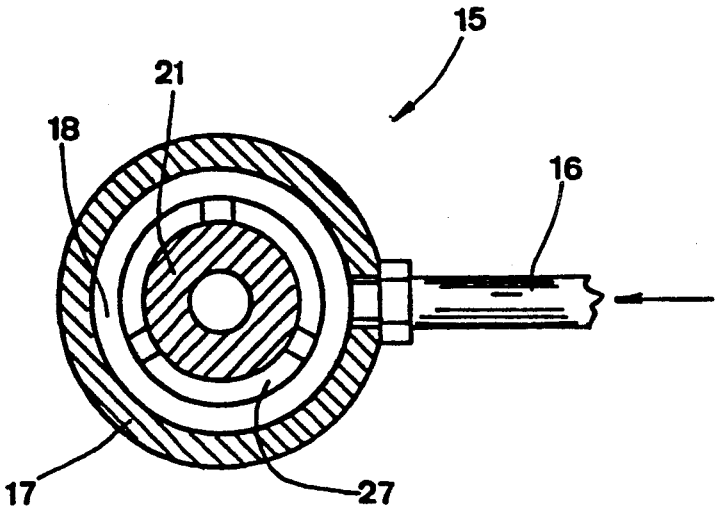
FIG. 4 is a transverse section of FIG. 2 seen in the direction of arrows from the line IV—IV showing the compressed air inlet section.
Figure 6:
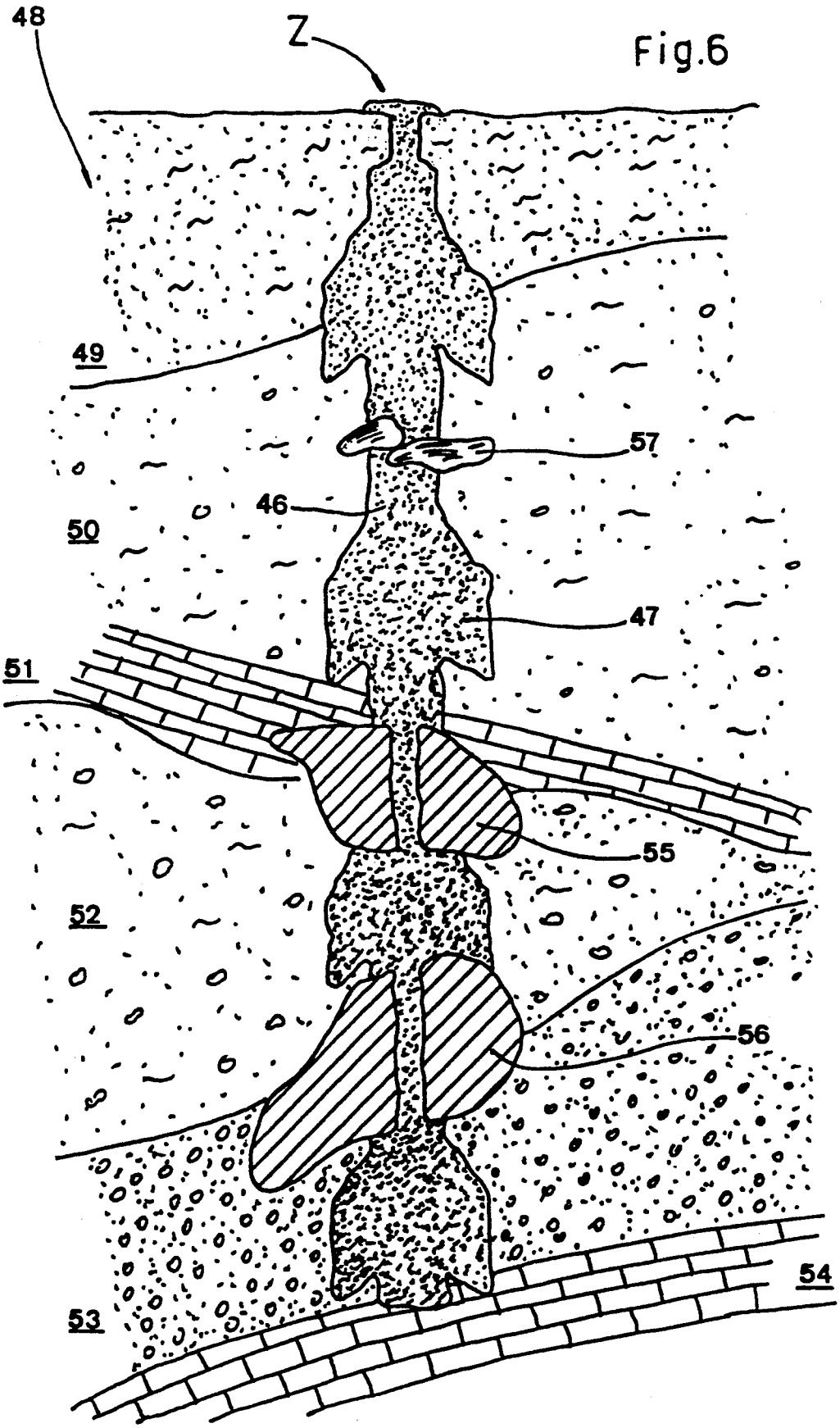
FIG. 6 is a stratigraphic profile of the earth illustrating a consolidated column passing through different types of lithologic element and large isolated stone elements.

A pair of inlet passages 23 and 24 (FIG. 3) for the consolidating grout are tangentially arranged in grout feed chamber 22 and inclined at an angle of between about 5° and 50° with respect to a vertical axis for generating a swirling downward movement of the grout.

A tubular body 25 having different outer diameters along its length, is placed between said rotary joint manifold and the air manifold 15.

This tubular body 25 supports the rotary joint manifold and allows the consolidating grout to pass from the rotary joint manifold to the air manifold. A seal 26 is arranged between the rotary joint manifold 6 and the tubular body 25 to prevent consolidating grout from leaking out of the feed chamber 22. The bottom of said tubular body is screwed to the top portion of the tubular section 21 of the air manifold 15.

The tubular body is provided with a supply of compressed air coming from the supply hose 16 and with a supply of consolidating grout coming from the grout feed chamber 22.

Air flow passages 27 interconnect the annular chamber 18 to an external annular chamber 28 provided in the body of the rotary drill 11, an internal chamber 29 allows passage of the consolidating grout being further provided in the body of the drill.

Reference numeral 30 denotes sections of the rotary drill 11, each section comprising an outer tubular portion 31 and an inner tubular portion 32, fixed to each other by the insertion of seven radial spacers 33.

One of the ends of the outer tubular portion, for example the lower end, is fitted with a threaded tang for screw coupling with a corresponding threaded nut 35 arranged at the top end of the outer tubular portion of the subsequent section.

The lower end of each inner tubular portion 32 has a reduced diameter allowing it to be inserted into the subsequent portion, with peripheral sealing elements interposed therebetween.

A grout distributor 36 comprises an external bored jacket 37 with at least one or, preferably, a pair of radially disposed pipes 38 each provided with an ejection nozzle 39 through which a flow of the consolidating grout is injected.

A pneumatic hammer 40 is equipped with a striking head 41 driven by compressed air supplied from the external annular chamber 38 of the drill via an air inlet chamber 42: the compressed air leaves the striking head through holes 43 provided in the body of the striking head and through coupling grooves 44 provided between the striking head and the body of the pneumatic hammer. A represents the angle between the axes of the radial pipes 38 and the axis of the drill, said angle being between about 15° and 90°.

A consolidating earth column 45 is formed while the drill is moving upward.

A consolidating earth column 46 with truncated cone-shaped sections 47 may be formed by injecting consolidating grout through nozzles 39 inclined downward.

48 is the earth in which the column is formed comprising the following layers: sandy clay 49, clay sand 50 containing small and medium-sized stones, sandstone 51, gravelly sand 52 in a weak clay matrix, gravel 53 in a weak sandy matrix and sandstone 54.

Erratic rock 55 lies between layers 51 and 52. Erratic rock 56 lies between layers 52 and 53, 57 is a medium-sized stone lying on layer 50 and Z is the outcrop.

Operations are carried out as follows: the rotary drill 11 is supplied with compressed air by the compressor 14 through the outer annular chamber 28 and the pneumatic hammer 40 starts drilling the earth while the rotary drill is pushed downward by the chuck 9, sliding along the pylon 12 on a slideway 10. Once the required depth has been reached, the rotary drill 11 is supplied with consolidating grout by the pump unit 5, the grout being introduced into the central chamber 29 through the rotary joint manifold 6 and injected into the earth through the nozzles 39 in the grout distributor 36 while the drill is moving upward and kept rotating. While the grout is injected into the earth, the pneumatic hammer 40 is supplied with a flow of compressed air at a pressure sufficient to prevent the grout from entering the holes 43 and the groves 44.

The outcrop Z or mixed earth formations at the top of the columns, including cone-shaped formations, may be removed by injecting consolidating grout at a relatively low pressure while the drill moving upward is approaching the surface of the earth; in any event, outcrop and any infiltrations may be eliminated by removing the earth at the top of the consolidated columns by means of a bucket.

We claim:

1. A method of forming consolidated earth columns by injection of a grout, comprising the steps of:

A. preparing a consolidating grout which includes aggregates with a granule size within the sand range, each constituent of the grout not exceeding about one third of a diameter of an opening through which a flow of the grout is to be injected into the earth;

B. drilling a hole into the earth, with a drill, to a required penetration depth, by exerting an impulsive stress repeatedly on the earth via an excavating drill head equipped with a pneumatic percussion tool provided with a supply of compressed air at a pressure between approximately 5 and 30 bar;

C. injecting a flow of the consolidating grout, via at least one jet with a diameter of between approximately 2 and 15 mm, positioned on a surface inclined from a drilling axis at an angle of between about 15° and 90°, the consolidating grout being injected with the at least one jet rotating around the drilling axis and as the drill rises from a bottom level of the hole, wherein the grout is fed at a pressure of at least about 500 bar at a flow rate of up to about 1000 1/ min as determined upstream form the drill, a supply of air being maintained to the pneumatic percussion tool at a pressure sufficient to prevent the grout form entering the tool, the consolidating grout being fed by a downward swirling movement thereof at the mouth of the drill; and forming a column while the drill is moving upward by regulating the vertical translation speed as well as the rotation speed of the drill and the flow rate and pressure of the grout according to the composition of the earth being worked on and the form required for the column such that for cylindrical sections such parameters are substantially constant, and for truncated cone-shaped sections the translation speed is reduced and at least one of the pressure or flow rate of the grout is increased.

2. Method according to claim 1, wherein the consolidating grout is composed as follows:

| | |
|---|---|
| cement | from 200 to 600 kg/m$^3$ |
| water | from 100 to 600 kg/m$^3$ |
| aggregates | from 300 to 1000 kg/m$^3$; |

the density of the consolidating grout being below 2200 kg/m$^3$.

3. Method according to claim 1, wherein the consolidating grout contains the following additives, int he weight percentages indicated below:

| | |
|---|---|
| bentonite | 1 to 5% |
| plastifying or densifying agent | 0.1 to 5% |
| epoxy resin | 0.1 to 5% |

-continued

| | |
|---|---|
| reswelling polymers | 0.1 to 5%. |

4. Method according to claim 1, wherein the consolidating grout has the following composition:

| | |
|---|---|
| water | 750 kg/m$^3$ |
| cement | 770 kg/m$^3$ |

and the working parameters have the following values:

| | |
|---|---|
| air supply pressure | from 10 to 12 bar |
| consolidating grout flow rate | from 150 to 600 l/min |
| vertical translation speed of the drill when the drill is moving upward | |
| for cylindrical sections | approx. 0.004 m/s |
| for truncated cone-shaped sections | approx. 0.002 m/s |
| drill rotation speed | from 10 to 30 Rpm |

the consolidating columns formed having cylindrical sections with a diameter of between about 60 cm and 100 cm and truncated cone-shaped sections with an average diameter of between about 90 cm and 135 cm, the consolidating grout being injected via a pair of jets with a flow diameter of between 3 and 5 mm, the jets being positioned diametrically opposed each other at a vertical distance of about 10 to 15 cm and being inclined form the drilling axis at a an angel of 60°.

5. A consolidating column, obtained according to the method of claim 1, formed with consolidating grout and having a substantially cylindrical shape, with truncated cone-shaped sections.

6. Consolidating earth column, obtained according to the method of claim 1, consisting of a cylindrical body along which downward-converging truncated cone-shaped projections protrude at fixed intervals.

7. A method of forming consolidated earth columns by injection of a grout comprising the steps of:

A. preparing a consolidating grout which includes aggregates with a granule size within the sand range, each constituent of the grout not exceeding about one third of the diameter of an opening through which a flow of the grout is to be injected into the earth;

B. drilling a hole in the earth, with a drill, to a required penetration depth, by exerting an impulsive stress repeatedly one the earth via a excavating drill head equipped with a pneumatic percussion tool provided with a supply of compressed air at a pressure between approximately 5 to 30 bar;

C. injecting a flow of the consolidating grout, via at least one jet with a diameter of between approximately 2 and 15 mm, positioned on a surface inclined from a drilling axis at an angle of between about 15° and 90°, the consolidating grout being injected with the at least one jet rotating around the drilling axis and as the drill rises form a bottom level of the hole, wherein the grout is fed at a pressure of at least about 500 bar at a flow rate of up to about 1000 l/min as determined upstream from the drill, a supply of air being maintained to the pneumatic percussion tool at a pressure sufficient to prevent the grout form entering the tool, the consolidating gout begin fed by a downward swirling movement thereof at the mouth of the drill; and D. forming a column while the drill is moving upward by regulating the rotation speed of the drill and the flow rate and pressure of the grout according to the composition of the earth being worked on and the form required for the column such that for cylindrical section such parameters are substantially constant and for truncated cone-shaped sections the pressure and flow rate of the grout is increased.

8. Apparatus for forming consolidated earth columns by injection of a grout comprising a water mixer for consolidating grout, a pump unit and a rotary drill provided with an external annular chamber and an internal chamber, said rotary drill being equipped at the top with a rotary joint manifold supplying consolidating grout followed by a compressed air manifold and at the bottom with a grout distributor and a pneumatic hammer, wherein said rotary joint manifold includes at least a pair of inlet passages tangentially arranged in a gout feed chamber and inclined at an angle of between about 5° and 50° with respect to a vertical axis, the compressed air manifold being equipped with at least one radially positioned hole through which compressed air is supplied to the pneumatic hammer via the external annular chamber of the drill, the grout distributor being equipped with at least one ejecting nozzle at the end of a radially disposed pipe.

9. Apparatus, according to claim 8, wherein a tubular body having different outer diameters along its length is placed between the rotary joint manifold and the compressed air manifold, said rotary joint manifold being rotationally supported by said tubular body.

10. Apparatus, according to claim 8, wherein said compressed air manifold comprises a tubular section equipped with a through axial hole allowing passage of the consolidating grout, said tubular section being rotationally connected to an external sleeve having said at least one radially positioned hole and equipped with a compressed air supply hose supplying compressed air into an annular chamber connected to said external annular chamber of the drill via air flow passages.

11. Apparatus, according to claim 8, wherein said grout distributor is connected to a lower end of the rotary drill and to an upper end of the pneumatic hammer supplied with a compressed air flow via the external annular chamber of the drill, the grout distributor being equipped with said at lest one radially disposed pipe connected at one end to the internal chamber of the rotary drill and the other end to a coaxial said ejecting nozzle, the ejecting nozzle having a flow diameter of between approximately 3 and mm and 15 mm and being inclined form the axis of the drill at an angle between about 15° and 90°, said nozzle being positioned on the external lateral surface of the distributor, at a distance of about 1 to 3 m from the pneumatic hammer.

12. Apparatus, according to claim 8, wherein said grout distributor is connected to a lower end of the rotary drill and to an upper end of the pneumatic hammer supplied with a compressed air flow via the external annular chamber of the drill, the grout distributor being equipped with a pair of said radially disposed pipes vertically distanced, each connected at one end to the internal chamber of the rotary drill and the other end to a coaxial said ejecting nozzle, each said ejecting nozzle having a flow diameter of between approximately 3 mm and 15 mm and being inclined form the axis of the drill at an angle between about 15° and 90°, said nozzles being positioned on the external lateral surface of the grout distributor at a different heights and at a distance of about 1 to 3 m form the pneumatic hammer.

13. Apparatus, according to claim 12, wherein at least one nozzle has an axis intersecting the axis of the rotary drill.

* * * * *